United States Patent [19]

Saadat

[11] Patent Number: 4,662,076

[45] Date of Patent: May 5, 1987

[54] COMPASS

[76] Inventor: Mohammad M. Saadat, Am Cleefkothen 30, 5600 Wuppertal 1, Fed. Rep. of Germany

[21] Appl. No.: 734,329

[22] Filed: May 15, 1985

[30] Foreign Application Priority Data

May 25, 1984 [DE] Fed. Rep. of Germany ..... 3419663
Aug. 13, 1984 [DE] Fed. Rep. of Germany ..... 3429795
Jan. 4, 1985 [DE] Fed. Rep. of Germany ..... 3500165

[51] Int. Cl.[4] ..... B43L 9/00
[52] U.S. Cl. ..... 33/27.02
[58] Field of Search ..... 33/27 R, 27 B, 27 C, 33/27 D, 27 F

[56] References Cited

U.S. PATENT DOCUMENTS 2,824,373 2/1958 Sjolund ..... 33/27 B
3,129,514 4/1964 Lintner ..... 33/27 B
3,358,371 12/1967 Liesong, Sr. ..... 33/27 B

*Primary Examiner*—Richard R. Stearns
*Attorney, Agent, or Firm*—Martin A. Farber

[57] ABSTRACT

A compass, comprising a sliding rod with a handle at an upper end, and a drawing portion. A slider is slidably mounted on the sliding rod. Two links are pivotally connected to the slider and to the drawing portion at respective first pivot points forming at least approximately a parallelogram. A crank is operatively pivotally connected to the sliding rod and to a center of one of the links at respective pivot points, the crank having a length between its pivot points equal to half the length of the link to which the crank is connected between the first pivot points of the one link.

16 Claims, 5 Drawing Figures

COMPASS

FIELD AND BACKGROUND OF THE INVENTION

The present invention relates to a compass for drawing a circle.

U.S. Pat. No. 2,824,373 discloses a well-known asymmetrical type compass which is used for drawing a rather small circle. Though this kind of compass is adjustable to make the center pin portion and the pencil portion parallel to each other, both hands are required for adjustment, and it requires a complicated mechanism and causes weakness of the structure. Other known compasses have other disadvantages.

SUMMARY OF THE INVENTION

An object of the present is to provide a compass which is easy to handle and makes the pin and pencil portion exactly parallel, or substantially parallel, and also provides stiffness to the structure.

According to the present invention, there is provided a compass comprising a pencil portion, a sliding rod with a handle, a slider on the sliding rod, two links pivotally connected to the slider and to the pencil portion at pivot points substantially defining a parallelogram, and a crank pivotally connected to the center of one of the links and to the sliding rod forming an isosceles triangle.

With the above and other objects and advantages in view, the present invention will become more clearly understood in connection with the detailed description of preferred embodiments, when considered with the accompanying drawings.

DETAILED DESCRIPTION OF THE PREFERRED EMBODIMENTS

Figure 1:
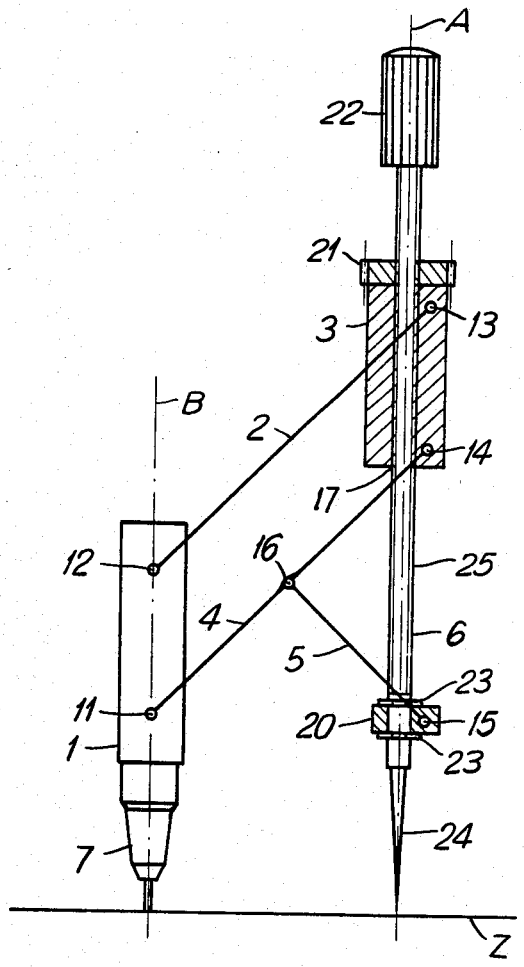
FIG. 1 is an elevational view partly in section of first embodiment of a compass of the asymmetrical type.

Referring to FIG. 1, a compass according to the invention comprises a pencil or drawing portion 1, a center pin portion comprising a sliding rod 6 and a slider 3 slidably mounted on the sliding rod 6, parallel links 2 and 4 pivotally connected to the slider 3 and to the portion 1, and a crank 5 pivotally connected to the center of the link 4 and to the sliding rod 6. The pencil portion 1 and the slider 3 are connected by the links 2 and 4 at their ends at pivots 11, 12, 13 and 14 respectively. The distance between the pivot points 11 and 12 is exactly the same as the distance between the pivot points 13 and 14 and the length of the two links 2 and 4 is also same between the respective pivot points 12, 13 and 11, 14. Therefore, a parallelogram is formed by the pencil portion 1, the links 2 and 4 and the slider 3. The crank 5 is pivoted to the center of the link 4 at pivot point 16. The other end of the crank 5 is pivoted to a carrier ring 20 mounted on the sliding rod 6 at the pivot point 15. Between the respective pivot points the length of the crank 5 is equal to one-half that of the link 4 forming isosceles triangles consisting of the pivot points 16, 11, 15 and 16, 15, 14, respectively.

The pivot points 15 and 14 are aligned parallel to the axis A of the sliding rod 6.

The carrier 20 is fixed at a lower position of the sliding rod 6 by washers 23, so as not to be axially movable along the axis A of the sliding rod 6, but it is rotatable therearound. The sliding rod 6 has a handle 22 secured thereto at its top, and a pin or needle 24 at its lower end. The sliding rod 6 is formed with a thread 25 between the handle 22 and the carrier 20, and the slider 3 has a cooperating thread 17 so that upon rotation of the sliding rod 6 by turning the handle 22 relative to the slider 3, the latter is axially moveable along the sliding rod 6. The slider 3 can be stopped at any position on the thread 25 by locking a knurled locking nut 21. The pencil portion 1 has a pencil 7 other marking means screwed into its lower end.

The operation of the compass is described hereinafter.

To draw a small circle, the slider 3 is turned and moved upwardly near handle 22 to provide a desired radius (distance of the pencil portion 1 from the sliding rod 6). To set this radius, the slider 3 is fixed to the sliding rod by the locking nut 21. Then, the needle 24 is set on the drawing surface Z, and the pencil portion 1 is turned in the usual way. To draw a large circle, the locking nut 21 is loosened, and the slider 3 is moved down on the sliding rod 6 which increases the distance between the sliding rod 6 and the pencil portion 1. Again at the desired radius, the locking nut 21 is tightened. A circle can now be drawn. The sliding rod can be provided with a scale for reading the adjusted radius or diameter by the relative movement of the slider 3 on the sliding rod 6.

As one need only turn the handle 22 and the locking nut 21 at the top near the handle, the adjustment is easily accomplished by one hand. As the compass has one parallelogram and two isosceles triangles, the pencil portion 1 (axis B) is always parallel to the sliding rod 6 and the structure is stiff and stable at every radius.

The crank 5 may be pivoted to link 2 instead of link 4 and/or the carrier 20 may be positioned at the top of the sliding rod with the slider 3 movable axially on the rod 6 below the carrier 20.

In the other embodiments the same parts are provided with the same reference numerals and similarly functioning but differently shaped parts with primed reference numerals, making some repeated description unnecessary.

Figure 2:
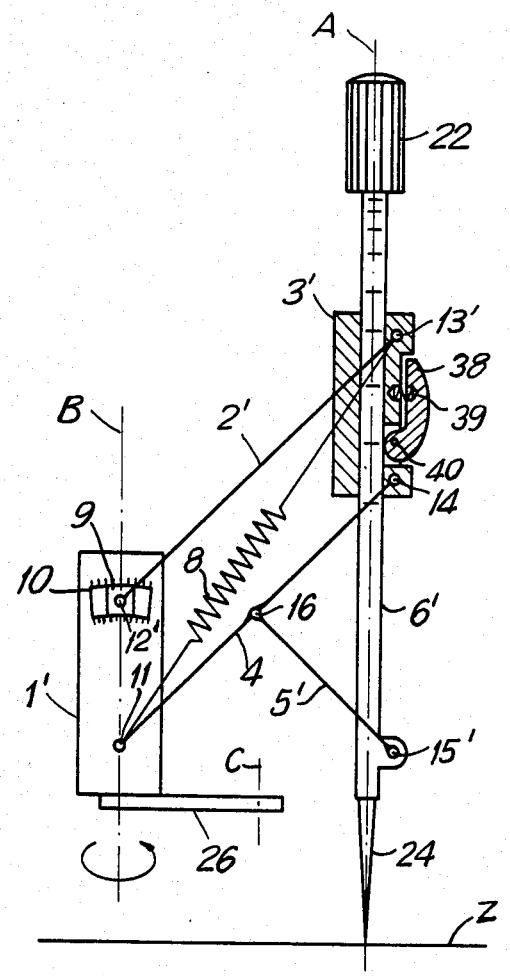
FIG. 2 is a similar view of another embodiment of the invention.

Referring to FIG. 2, fixed pivot point 15′ of crank 5′ is fixedly connected with the sliding rod 6′. The slider 3′ can only be moved straight along its sliding axis A. This embodiment permits a very quick adjustment of any drawing radius.

A tension spring 8 is diagonally arranged between the pivot points 11′ and 13′ of the parallelogram 1′,2′, 3′, 4′ urging the drawing portion 1′ radially outwardly. Spring 8 can also be mounted between the pivot point 15′ and the slider 3′.

A locking mechanism comprises a lever 38 pivotally connected at pivot point 40 to the slider 3′. One end of the lever 38 is biased by a compression spring 39 mounted on the slider 3′ such that the cammed other end of the lever 38 acts with its cam against the sliding rod 6′ against the action of the spring 8 on the slider 3′ which spring increases the engaging force. The compression spring 39 only serves to insure that the cam of the lever 38 acts against the sliding rod 6'.

In operation, to increase the radius of the compass the upper projecting end of the lever 38 is merely sensitively pressed with a finger of one hand. The drawing pencil is then automatically moved by the spring force of the spring 8 radially outwardly while the slider 3 moves down towards the drawing plane Z. The slider 3' is immediately locked by releasing the pushed-in lever 38.

To decrease the radius of the compass, the slider 3' need only be lifted, i.e. with two fingers of one hand, against the force of the spring 8, because of the decreasing frictional force of the cam of the lever 38 against the rod 6'. This releases the slider 3' automatically for upward movement, without the need for a person to touch the upper projecting arm of the lever 38. After the person releases the slider 3' at the desired radius the cam by the lever 38 locks the slider 3' in position holding the desired radius. This embodiment provides a one-way lock which slides up even when "locked".

The tension spring 8 can also be arranged between the closer pivot points 12 and 14 instead of between the pivot points 11 and 13'. In this embodiment the drawing portion 1' is urged radially inwardly and the locking mechanism 38 and 40 must be arranged to act in the opposite direction.

FIG. 2 further shows a cam guide 10 formed on the drawing portion 1' extending along a circular arc with respect to the pivot point 11. A sliding block 9 slidably engages the cam guide 10. The corresponding end of the link 2' is pivoted at pivot point 12' to the sliding block 9. Accordingly the drawing portion 1' can be swiveled such that the pencil point can be turned toward the pin 24 when drawing small circles. It is enough to provide a certain friction between the sliding block 9 and the cam guide 10; an additional clamping device is not absolutely necessary. For drawing even smaller circles a drawing pencil can be screwed at axis C of an additional lever 26 which lever is rotatable around axis B such that the pencil point can approach the point of the pin 24.

Figure 3:
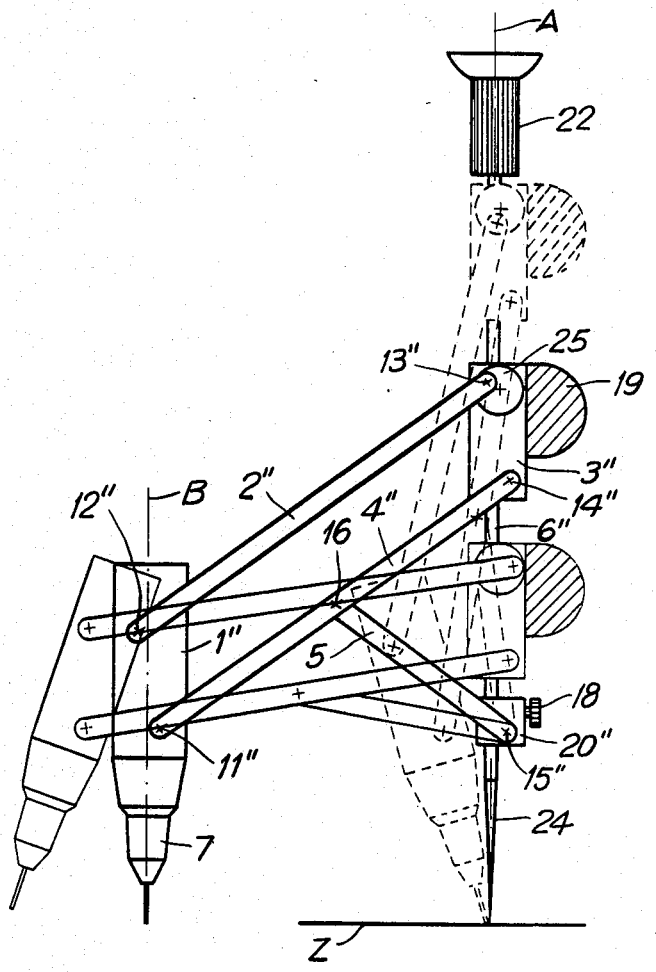
FIG. 3 is an elevational view of a third embodiment of the invention.

As shown in FIG. 3 for drawing small circles the parallelogram is slightly off a perfect parallelogram shape. One member of the parallelogram linkage 1'', 2'', 3'', 4'' (for example, the distance between pivot points 13'' and 14'') must be chosen a little shorter than the distance of the opposite points 11'' and 12''.

A cylindrical plate 25 is rotatably mounted on the slider 3'' and the pivot point 13'' of the upper link 2'' is eccentrically pivoted on the plate 25. For adjusting the plate 25 in the slider 3'', simply a certain friction is provided between the slider 3'' and the plate 25.

The operator can now adjust to the exact parallelograpm shape (1''–4'') as shown in solid thick lines. When drawing circles of large or small diameter the operator can change its adjustment. In the approximately parallelogram form, circles of even greater diameter (and smaller diameter, as shown in dashed lines) can be drawn. The tip of the drawing pencil 7 now moves along an elliptically curved path of great curvature into its radially outward position, as shown in thin solid lines (at the left side of FIG. 3).

In FIG. 3 the slider 3'' is provided with a button 19 on its upper side for the purpose of simple handling. The button 19 can be designed as a push-button including a clamping device (not shown) for quickly adjusting the slider 3'' on the sliding rod 6''. The fixed pivot point 15 is arranged on a carrier 20'' which is adjustably mounted on the sliding rod 6'' by a locking screw 18.

Figure 4:
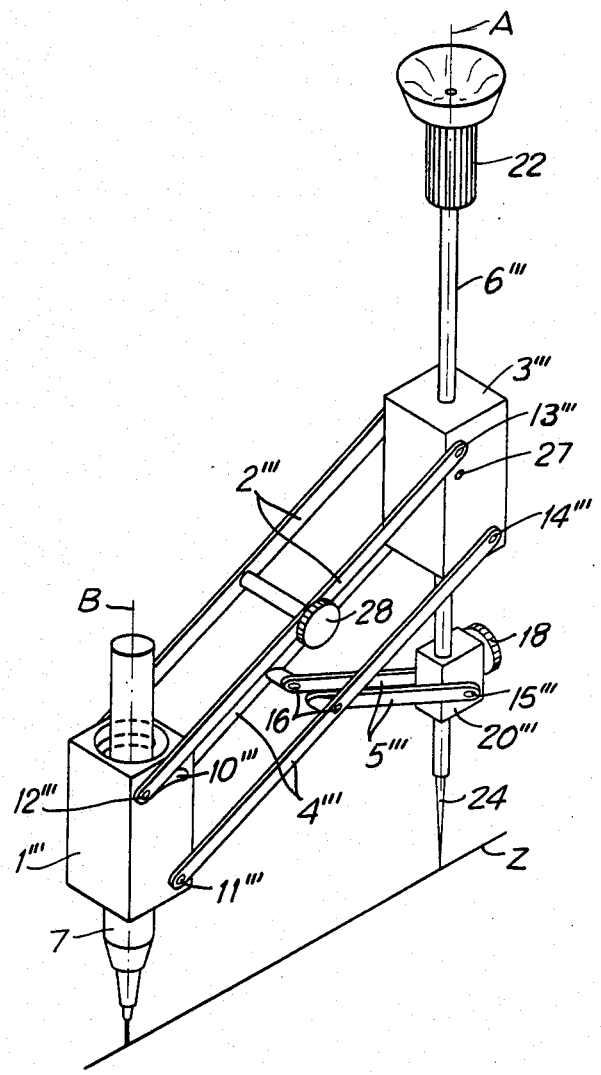
FIG. 4. is a perspective view of a fourth embodiment of the invention.

Referring now to FIG. 4 a perspective view of a compass of the asymmetrical type is shown. The crank 5''' and links 2''', 4''' practically are provided in double arrangement on both sides, respectively, for optimum stiffness. The pivot points 13''' of the upper pair of rods 2'''engage with their pins selectively into corresponding bores, one of which is referenced as bore 27, such that the connection of both rods 2''' can be changed from an exact parallelogram to the approximate parallelogram shape of the linkage 1'''–4'''. A spacer screw 28 secures the engagement of the rods 2 in the bores and serves for increased stiffness of the entire guide linkage 1''' to 6'''. For drawing circles of small diameters, alternatively a cam guide as described in FIG. 2 can be provided.

In FIG. 4, the slider 3''' does not generally need any clamping device for adjusting the drawing radius. Because of the exactly straight (parallel) motion guide of the drawing portion 1''' relative to the sliding rod 6''' any reaction force acting on the drawing pencil 7 cannot move the slider 3''' along the slider rod 6'''. Also in the approximate parallelogram shape, the deviation from the straight motion guide is only small, such that a certain sized friction between the slider 3''' and the sliding rod 6''' keeps the entire guide linkage 1''' to 6''' in its adjusted position.

Figure 5:
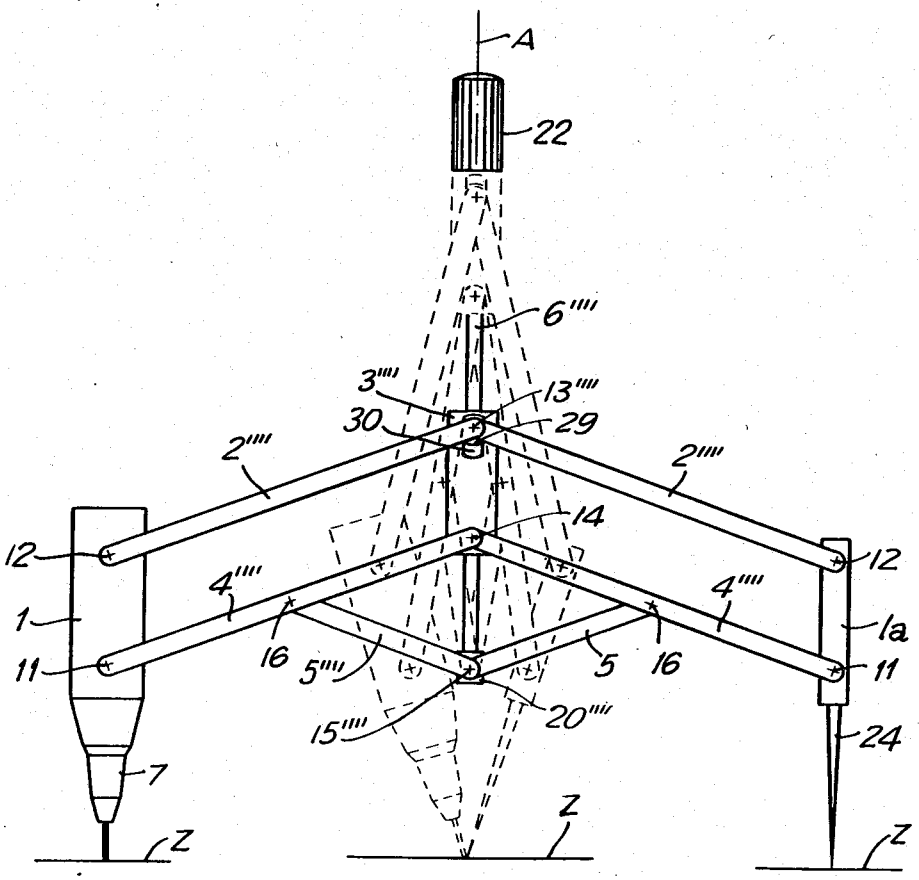
FIG. 5 is an elevational view of a symmetrical compass as a fifth embodiment of the invention.

FIG. 5 shows a compass of the symmetrical type. Two parallelogram linkages as described in FIG. 1 are arranged with mirror symmetry to each other having a common slider 3'''' slidably mounted along the elongated axis A of the sliding rod 6'''' having a compass handle 22 rigidly connected thereto. The slider 3'''' is again arranged near the handle 22, and the fixed pivot points 15'''' of both cranks 5''' are connected in a double joint 15'''' on the carrier 20'''' which is axially fixed on an end of the sliding rod 6'''' facing the drawing plane Z. The handle 22 can be easily overlapped by one hand of a person to adjust the slider 3'''' which is relatively near the handle for adjusting any circle radius. The pin or needle 24 is mounted in a coupler 1*a*. This arrangement allows one to draw circles of double diameter while the compass handle 22 is guided along a circle around the pin 24 while drawing.

Either both of the four-bar linkages 1'''', 2'''', 3'''', 4'''', as shown, or only the four-bar linkage for the drawing portion 1 may be designed adjustable from its exact parellelogram to an approximate parallelgram shape for drawing circles of small diameter. For this an adjusting mechanism is provided comprising a sliding block 29 slidably arranged in a linear guide 30 formed in the slider 3''''. The links 2'''' are pivoted at pivot point 13'''' to the sliding block 29 which allows a common change of both four-bar linkages 1''''–4'''' from their exact parallelgram forms, shown in solid lines in a position for drawing circles of greater diameter, into its approximate parallelogram form, shown in dashed lines in a position for drawing small circles. Both positions of both four bar linkages 1'''', 2'''', 3'''', 4'''' are again adjusted by a certain sized friction between the sliding block 29 in its guide 30.

By a symmetrical arrangement of the guide linkages 1'''' to 6'''', forces on the top of the handle 22 acting together with their reaction forces at the points of the drawing pencil 7 and the pin 24 in the case of an exact straight line motion guide, cannot move the slider 3'''' along the sliding rod 6''''. In the case of an approximately straight line motion guide, for drawing circles of small diameter, the line-curves of the drawing portion 1 and the coupler 1*a* deviate only insignificantly from a straight line motion guide. Therefore, a certain friction force acting between the slider 3'''' and the sliding rod 6'''' is also sufficient to adjust the selected circle radius of both guide linkages 1'''' to 6''''.

The links 2'''' and 4'''' as well as the cranks 5'''' of both guide linkages practically again are provided on both sides of the drawing portion 1, the coupler 1*a*, the slider 3'''' and the carrier 20'''', as described before in reference to FIG. 4.

What I claim is:

1. A compass, comprising a sliding rod with a handle at an upper end, a drawing portion adapted to be connected with a marking means for drawing, a slider axially movably mounted on said sliding rod, two links pivotally connected adjacent respective ends thereof to said slider and to said drawing portion at respective first pivot points forming at least approximately a parallelogram, and a crank operatively pivotally connected adjacent respective ends thereof to said sliding rod and to a center of one of said links at respective second pivot points, the crank having a length between said second pivot points equal to half the length of said one link between said first pivot points of said one link.

2. The compass according to claim 1, wherein said sliding rod defines an axis coinciding with said handle as well as with a sliding axis of said slider, said handle being axially elongated.

3. The compass according to claim 2, wherein said first pivot points form approximately the parallelogram such that a bottom of said drawing portion points toward a bottom point of said sliding rod for drawing circles of small diameter.

4. The compass according to claim 3, further comprising means for adjusting said first pivot points into said approximate parallelogram.

5. The compass according to claim 2, wherein said slider is between said handle and the one of said second pivot points which operatively pivotally connects the crank to said sliding rod.

6. The compass according to claim 5, wherein said one of said links is a closest of said links to the one of said second pivot points which operatively pivotally connects the crank to said sliding rod.

7. The compass according to claim 2, wherein said sliding rod passes through said slider.

8. The compass according to claim 7, wherein said sliding rod and said slider are formed with cooperating screw threads, a ring axially fixed and rotary mounted on said sliding rod, the one of said second pivot points which operatively pivotally connects the crank to said sliding rod is on said ring.

9. The compass according to claim 7, wherein said sliding rod is provided with scale means for reading exact values of spacing of said drawing portion from said sliding rod.

10. The compass according to claim 7, further comprising spring means between said two links for biasing said drawing portion in one active direction and said slider in another active direction, and a releasable locking means for locking said slider on said sliding rod against the active direction of said spring means on said slider.

11. The compass according to claim 1, further comprising a coupler having a point at a bottom thereof, two second links pivotally connected adjacent respective ends thereof to said slider and to said coupler at respective third pivot points forming at least approximately a parallelogram, and a second crank operatively pivotally connected adjacent respective ends thereof to said sliding rod and to a center of one of said second links at respective fourth pivot points, the second crank having a length between said fourth pivot points equal to half the length of said one second link between said third pivot points of said one second link.

12. The compass according to claim 11, wherein both of said first pivot points and respectively of said third pivot points form approximately said parallelograms such that a bottom of said drawing portion points toward said point of said coupler for drawing circles of small diameter.

13. The compass according to claim 12, comprising means for adjusting said first and third pivot points into said approximate parallelograms.

14. The compass according to claim 11, wherein said slider is between said handle and the one of said second pivot points which operatively pivotally connects the first-mentioned crank to said sliding rod and the one of said fourth pivot points which operatively pivotally connects said second crank to said sliding rod.

15. The compass according to claim 14, said one of said first-mentioned and second links is a closest of said first-mentioned links and of said second links, respectively, to the one of said second pivot points which operatively pivotally connects the crank to said sliding rod.

16. The compass according to claim 11, wherein said sliding rod passes through said slider.

* * * * *